US011324328B1

(12) United States Patent
Posner

(10) Patent No.: US 11,324,328 B1
(45) Date of Patent: May 10, 2022

(54) RECREATIONAL MATTRESS

(71) Applicant: Scott Posner, Gurnee, IL (US)

(72) Inventor: Scott Posner, Gurnee, IL (US)

( * ) Notice: Subject to any disclaimer, the term of this patent is extended or adjusted under 35 U.S.C. 154(b) by 566 days.

(21) Appl. No.: 16/350,632

(22) Filed: Dec. 10, 2018

Related U.S. Application Data

(60) Provisional application No. 61/606,792, filed on Mar. 5, 2012.

(51) Int. Cl.
*A47C 17/64* (2006.01)
*A47C 31/10* (2006.01)
*A47C 27/12* (2006.01)

(52) U.S. Cl.
CPC ..... *A47C 17/64* (2013.01); *A47C 27/12* (2013.01); *A47C 31/105* (2013.01)

(58) Field of Classification Search
CPC ..... A47C 17/64; A47C 27/007; A47C 27/12; A47C 27/122; A47C 31/105
See application file for complete search history.

(56) References Cited

U.S. PATENT DOCUMENTS 4,324,012 A * 4/1982 Cannaday ..... A41F 15/007 5/656
5,639,543 A * 6/1997 Isoda ..... D04H 3/03 428/220
7,625,629 B2 * 12/2009 Takaoka ..... B29C 43/02 428/220
D632,502 S * 2/2011 Gillespie ..... D6/335
8,899,677 B2 * 12/2014 Hurlburt ..... A47C 13/00 297/219.1
10,264,888 B2 * 4/2019 Clark ..... A47C 1/143
2009/0139034 A1 * 6/2009 Maarbjerg ..... A47C 31/105 5/723
2012/0042452 A1 * 2/2012 Takaoka ..... A47C 31/006 5/691
2015/0020316 A1 * 1/2015 Khambete ..... A47C 27/12 5/655.6

* cited by examiner

*Primary Examiner* — Ryan A Reis

(57) ABSTRACT

A mattress has a cover sewn over a cushioned non-absorbent core and is suitable for use as a resting place or sleeping space. The core is made of a netted material having a plurality of tangled, partially bonded filaments. The cushions can have various densities separated by baffles inside the cover. The cover can have a built in or added back support system. The mattress is a self contained carry case and needs no additional carry bag. A detachable shoulder strap doubles to carry the mattress and as adjustable straps to adjust the back support system. The cushion is manufactured in various sizes for standard outdoor camping as well as sizes for standard indoor bedding.

6 Claims, 21 Drawing Sheets

Top View

RECREATIONAL MATTRESS

CROSS-REFERENCE TO RELATED APPLICATION

This application claims the benefit of U.S. Provisional Patent Application Ser. No. 62/606,792 filed Oct. 10, 2017, the disclosures of which are hereby incorporated by reference in their entirety.

BACKGROUND OF THE DISCLOSURE

The present disclosure generally relates to a water resistant cushion mattress designed primarily for outdoor recreational use such as in camping pads, beach pads, patio cushions and mattresses for recreational vehicles, however It can also be used for indoor furniture, outdoor furniture, bedding and marine cushions for water boats of all types. The cushion of the present disclosure may be referred to herein as the Eco-Lastic cushion with Eco-lastic being the inventor's trademark for the device.

Current camping pads and camping mattresses on the market are made up of 3 categories: closed cell foam pads which have a hard or boardy feel to them when laid on. Air mattresses which can be blown up or inflated by an air pump and self inflating mattresses which use polyurethane foam inside an air mattress for added comfort. Air mattresses and self inflating mattresses both have the disadvantage of punctures and deflating and/or air leaking out of the seams and can be difficult to roll up for carrying and storage.

The Eco-Lastic cushion does not use air to inflate and will not absorb moisture and become moldy like polyurethane foams, additionally it is supportive and comfortable unlike closed cell foam pads.

SUMMARY OF THE DISCLOSURE

The present disclosure generally provides a sturdy synthetic waterproof cushioning material suitable as an outdoor recreational mattress. The cushion has a core that is a batt of netted fibrous material. The core is formed by randomly entangled bonded synthetic strands with open spaces between the fibers. The core is encased in a cover. The cover could take various forms but one embodiment has top and bottom layers of ripstop nylon fabric with a polyurethane coating on one side and on thicker size mattresses is joined by side panels of a similar type fabric. A pocket made of synthetic mesh fabric is sewn to the underside of the bottom panel with a zipper enclosure to hold valuables and also doubles as a pillow holder. Another embodiment shows a pocket with a fabric zippered enclosure attached to the top of the cover. The mattress is a self contained carry case and needs no additional carry bag.

The Eco-Lastic mattress has advantages over conventional air mattresses in that it uses no air to inflate and therefore the cover can be punctured or torn and the cushion will not lose its comfort and other features described in this disclosure. The durability of the Eco-Lastic mattress allows it to be used in other outdoor activities e.g. outdoor concerts, beaches, around campfires and rough outdoor terrain where air mattresses and self inflating mattresses are limited due to potential leaks caused by punctures or tears in the cover. Additionally air mattresses deflate in cold air and expand in hot air causing the user to adjust the pressure inside the mattress. Outdoor temperature fluctuations between cold and hot will not contract or expand the material used as the cushioning material in the Eco-Lastic mattress.

BRIEF DESCRIPTION OF DRAWINGS

FIG. 20 shows an A-Frame support that allows the bed to be held upright or adjusted to many angles in semi-upright positions for sitting against or relaxing on.

DETAILED DESCRIPTION

Figure 1:
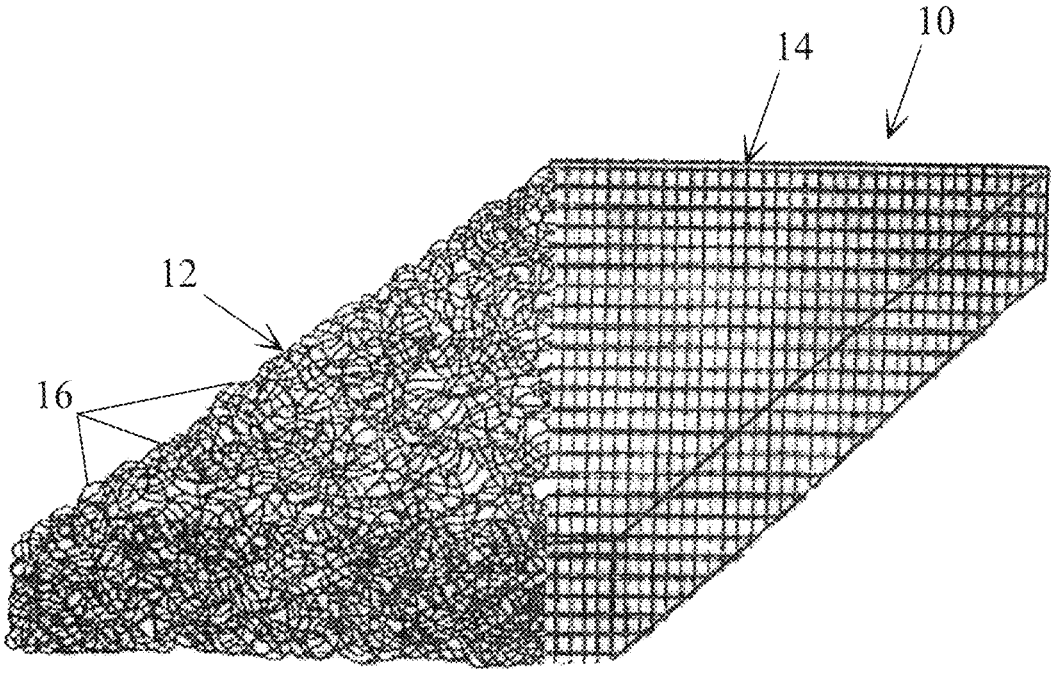
FIG. 1 is a perspective view of the cushion of the present disclosure, with the left-hand portion of the cover broken away to reveal the underlying core.

The Eco-Lastic cushion of the present disclosure is shown generally at 10 in FIG. 1. It has a core 12 of cushioning material and a cover 14 surrounding all or most of the core. In FIG. 1 the left-hand portion of the cover 14 is cut away to show the underlying cushion core 12. The dimensions of the mattress uses standard camping sizes in the market. The mattress in this diagram uses a mattress 25" wide×72" long×2 "thick and when rolled up measures approximately 25" wide×10" in depth×10" in height, however many other standard sizes can be used such as in the bedding industry and even custom sizes as well and the accompanied roll/fold up size will change accordingly.

Figure 2:
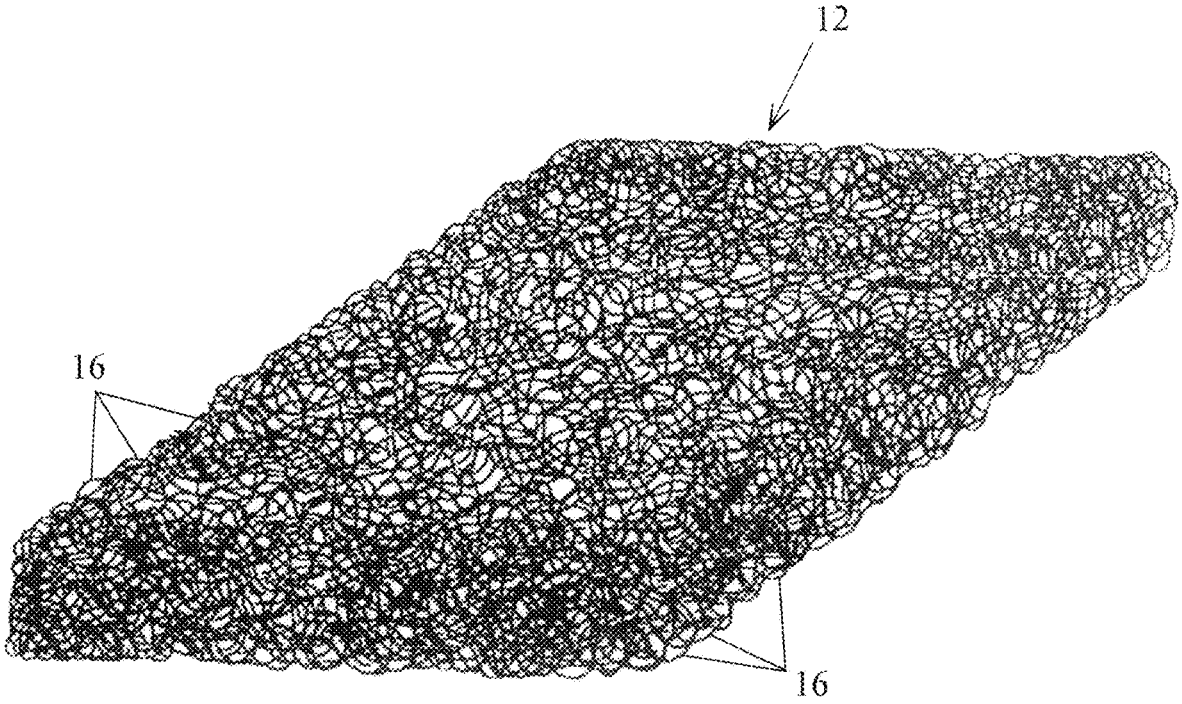
FIG. 2 is a perspective view of a core of netted material.

The cushioning material of the core 12 in FIG. 1. is a batted netted structure shown in U.S. Pat. No. 7,625,629, the disclosure of which is incorporated herein by reference. In summary, the core is a three-dimensional, netted structure manufactured by preparing a thermoplastic resin as a raw or a main raw material. The resin is melted and formed into a plurality of helically and randomly entangled, partly and thermally bonded filaments by extrusion molding and cooling the resultant filaments with a liquid so as to obtain a netted structure having hollow portions arranged in the material extruding direction. U.S. Pat. No. 7,625,629 provides a method of and an apparatus for manufacturing a three-dimensional netted structure, capable of rendering it unnecessary to carry out a finishing operation in a later stage, improving the degree of straightness of the side surfaces of the netted structure, meeting a demand for finishing the netted structure to modified shapes and improving the durability of the netted structure. A representation of the netted structure that forms the core is shown generally at 12 in FIG. 2. Examples of individual filaments in the core are visible at 16.

This core material used in the Eco-Lastic mattress has many advantages over current cushioning materials on the market such as foam pads and air mattresses. The cushioning material as the core in the Eco-Lastic mattress is waterproof, hypoallergenic and will not flatten out and take a set like other polyurethane foam cushions on the market. The Eco-Lastic mattress core is made from low-density polyethylene (LDPE) and is non toxic, giving off no toxic fumes, no chemical off gases and remains that way for the useful life of the product. This netted structure produces a long lasting cushioning material that can be pre-made to various shapes and sizes or cut to the height, length or width of the final Eco-Lastic product without adding additional layers or materials. During the manufacture of the core material it can be adjusted into different sizes and weights for consumers. A firm core will support a heavier weight and a soft core will be used for lighter weights. The material is waterproof and easy to clean alone by water or detergents and antimicrobial sprays and other cleaning agents. The three dimensional open structure of the cushioning material allows water and cleaning agents to easily penetrate its core.

Because of the helically and randomly entangled bonded filaments in U.S. Pat. No. 7,625,629, the structure of the core is not suitable for consumers as a bed or resting place alone. The reason is the cushioning material of the core has gaps between the bonded filaments that would allow a human's fingers to get caught inside the cushioning material if it were used alone. Additionally it would be easy for debris to get trapped inside the core. Accordingly, the Eco-Lastic cushion surrounds all or most of the core with the cover at 14 in FIG. 1.

Figure 3:
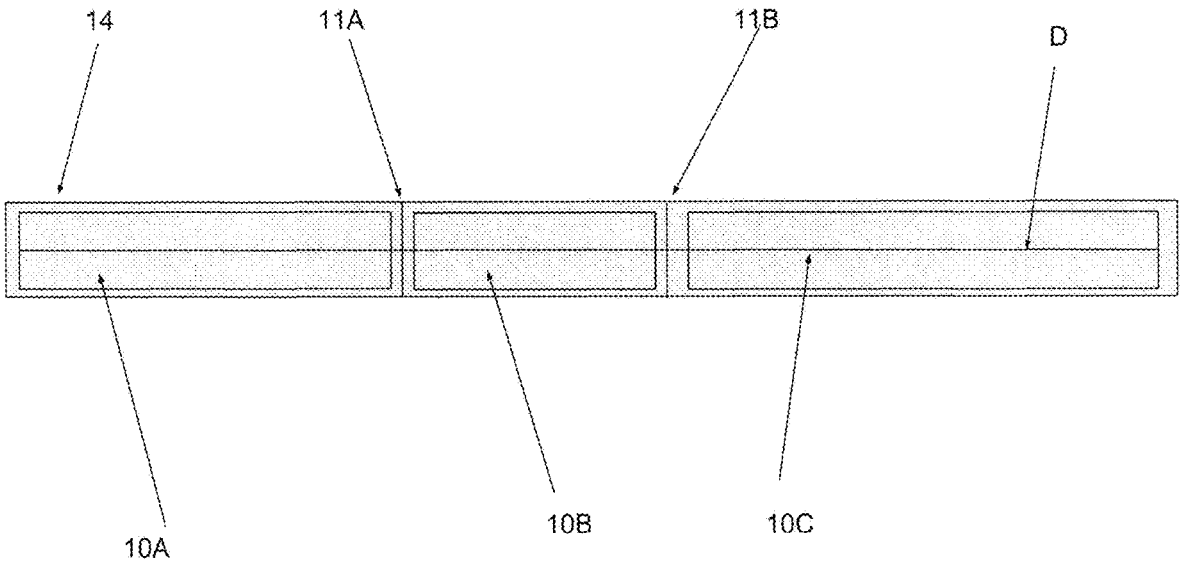
FIG. 3 is a side view of the camping bed with three (3) sections of cushions of various densities separated between baffles, the baffles keep the cushions from shifting during use, or rolling/folding up for transporting/storage.

One of the objects of the disclosure is to keep weight, bulk and cost down of the Eco-Lastic mattress, the cushioning material is made of 3 different densities FIG. 3. 10A, 10B, and 10C, distributed inside the cover 14 and separated by two (2) baffles 11A and 11B which keep the cushions contained so they do not slide or buckle over each other.

The cushions cores are distributed within the cover between the baffles. The lower section 10C is made of the lowest and lightest density of cushion where the weight of the body is not as crucial, the mid section 10B has the highest firmest density to support the hip section and the top section supporting the upper body, shoulders and head is made up of a medium density cushion 10A. A zipper D running along the long side of the cover 14 allows the cushion cores to be inserted into the cover between the baffles. In a standard size outdoor camping mattress with the dimensions 25 wide×72 long×2 thick the lower section 10C would have a cushion size of 25" wide×30" long×2" thick. The middle section 10B would have a cushion size of 25" wide×14" long×2" thick. The upper section 10A would have a cushion size of 25" wide×28" long×2" thick. The covers may be made slightly smaller so when cushions are inside the cover and zipped up the cover fabric is taught and has a firm feel and finished look without wrinkles. One embodiment for the cover 14 uses a ripstop nylon fabric of 200 denier. These fabrics typically have a polyurethane coating on one or both sides to keep moisture out, however the fabric can be a breathable cotton or synthetic or a combination thereof.

To add additional savings in weight bulk and cost lighter and less costly cushion cores can be added to sections 10A and 10B in FIG. 3. Sec 10B can be made of two (2) cushion cores, a lighter 2.4 lb density cushion core approximately ⅓ of the space placed closer to the legs and a heavier 2.8 lb density cushion core ⅔ the space and placed closer to the waist. Sec 10A can be made of two (2) cushion cores, a lighter 1.8 lb density cushion core approximately ⅓ of the space placed at the head and a heavier 2.4 lb density cushion core ⅔ of the space placed above the hips.

Figure 4:
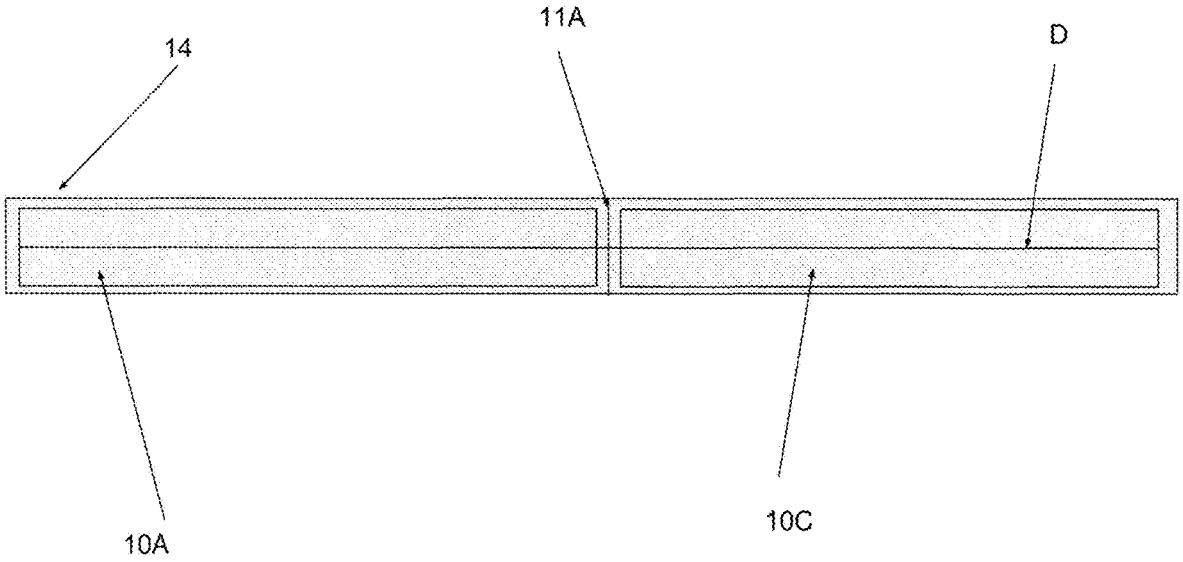
FIG. 4 is a side view of the camping bed with two (2)) sections of cushions of various densities separated between baffles, the baffles keep the cushions from shifting during use, or rolling/folding up for transporting/storage.

FIG. 4 illustrates another variation of the standard size outdoor mattress with dimensions 25" wide×72" long×2" thick. This embodiment uses a single baffle 11A located at the hip section of the cover which would separate two (2) cores 10A and 10C each two (2) inches in thickness to be distributed within the cover 14, one (1) cushion core 10C of a lower density (approximately a 1.8 lb density cushion core) below the hips extending to the feet which measures 25" wide×30" long×2" thick, and one (1) cushion core 10A of higher density (approximately a 2.8 lb density cushion core) which measures 25" wide×42" long×2" thick placed inside the cover at the hips extending to the head. Zipper D running along the long side of the cover 14 allows the cushions to be inserted as in the earlier description of paragraph 5. This configuration would allow for a firmer more supportive mattress where the carry weight of the mattress is not as important.

Figure 5:
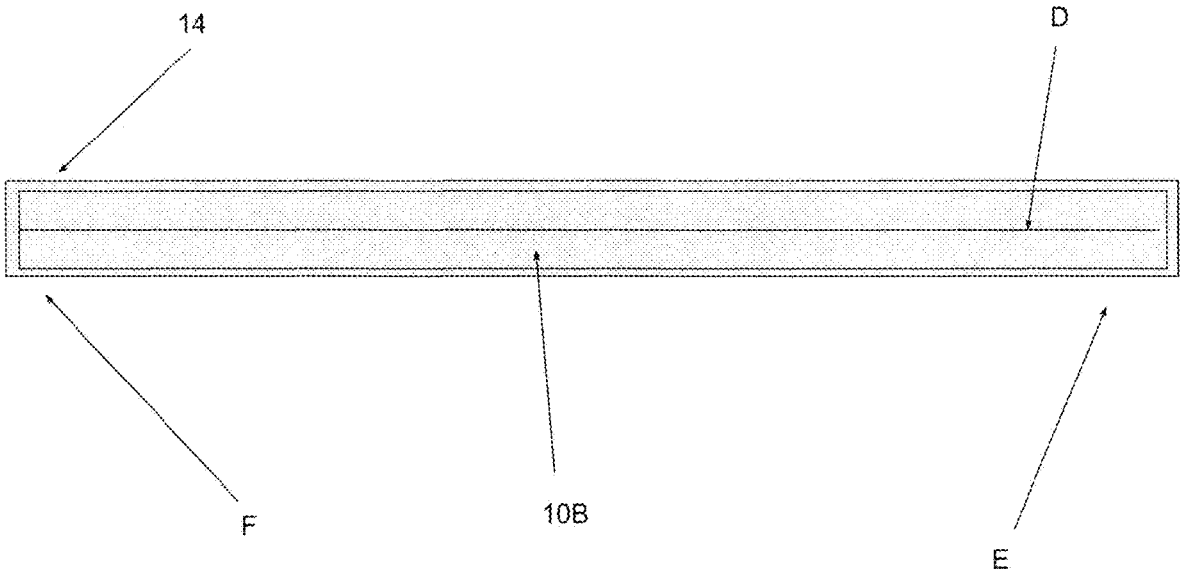
FIG. 5 is a side view of the camping bed with one (1) solid section of cushion core with no baffles.

FIG. 5 illustrates yet another variation of the standard size outdoor mattress 25" wide×72" long×2" thick. This embodiment uses no baffles in the cover 14 and one (1) solid piece 10B of higher density cushion (approximately 2.8 lb. density core). A zipper D running along the long side of the cover 14 allows the cushion cores to be inserted. In this configuration a firmer cushion core is more crucial than the carry weight of the mattress bed.

Figure 6:
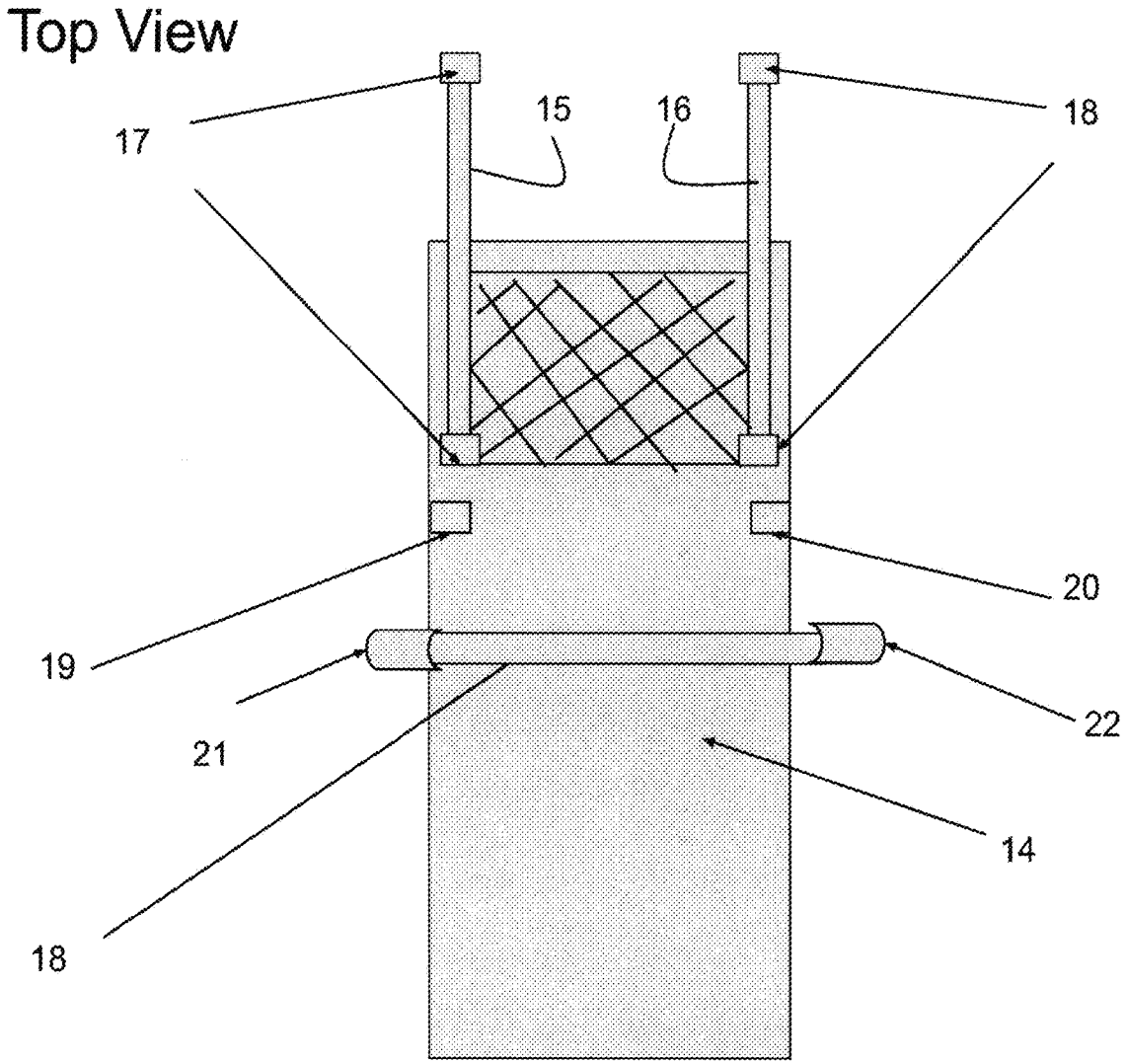
FIG. 6 is a top view of the camping bed showing adjustable webbing straps that engage it's ends to secure the bed when rolled/folded up and create a self contained carry case without the need of an additional carry bag.

FIG. 6 shows a top view shows the standard size camping bed is a self contained carry case and needs no additional carry bag. By using adjustable webbing 15 and 16 partially sewn into the bottom layer A of the cover 14 with side release buckles 17 and 18 on its ends, the mattress can be rolled up and held together by the engaged buckles. An adjustable shoulder strap 18 with two (2) attached swivel hooks 21 and 22 on each end engage two (2) hooks 19 and 20 attached on each side of the mattress cover 14 and allow the rolled up mattress to be carried around. Each strip of webbing is sewn approximately three (3) inches from the each edge of the mattress cover 14 on the bottom layer A and is approximately fifty (50) inches in length which is sufficient to hold the camping pad secure once it has been rolled up.

Figure 7:
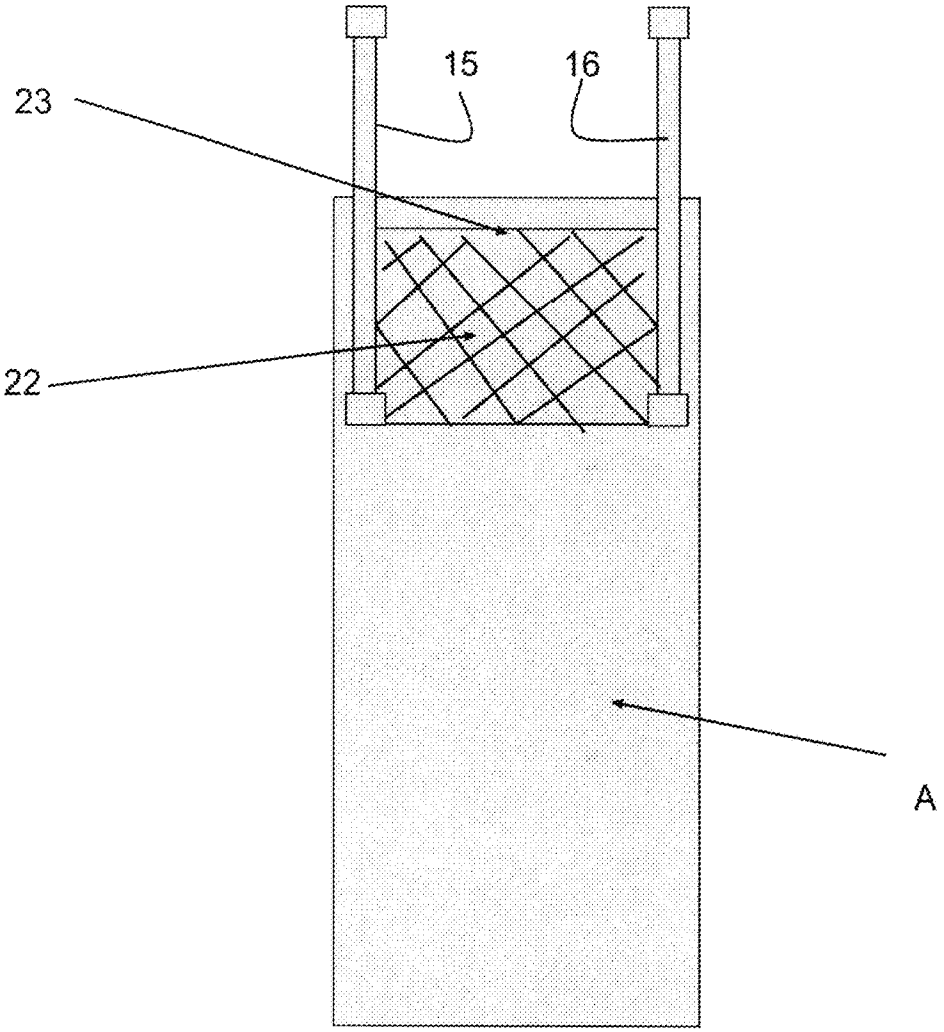
FIG. 7 is a top view showing the mesh pocket and webbing straps to enclose the sides of the pocket.

FIG. 7. shows a pocket made of open synthetic mesh fabric 22 with a zipper enclosure 23 on the bottom panel A and is used to hold valuables and also double as a pillow. The mesh pocket is large enough to place a small jacket or other items to create a pillow effect.

The two (2) webbing straps 15 and 16 on opposite ends of the mesh pocket which are used to hold the mattress secure when rolled up also doubles to make up the sides of the mesh pocket, thereby lowering materials and labor costs and gives the mesh pocket additional strength when holding larger items. The mesh pocket is approximately eighteen (18) inches wide by eleven (11) inches in length for a recreational mattress the dimensions of 25"×72"×2" as described in this disclosure. For each different size mattress the accompanying mesh pocket will be the width between the two webbing straps sewn onto each side of the mattress cover with an approximate length of eleven (11) inches.

Figure 8:
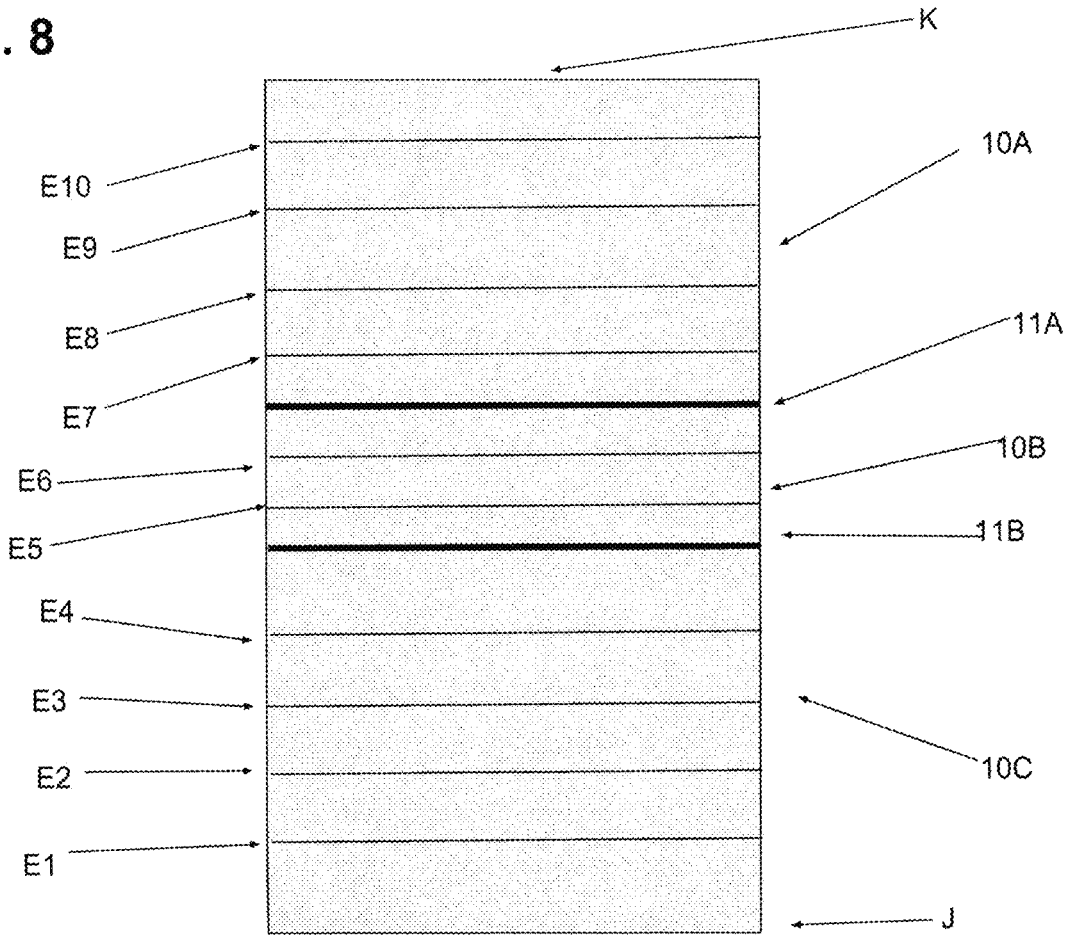
FIG. 8 is a top view showing sections of cores of different densities between baffles, the cores have horizontal cuts app: ¼" deep into the top sides.

FIG. 8. shows a top view of the Eco-Lastic mattress with the cover removed for viewing purposes. The core which makes up the cushioning material of the Eco-Lastic mattress is made of randomly entangled and bonded synthetic strands with open spaces between the strands, it has great resilience when a vertical force is applied from top to bottom, however when forces are applied horizontally across the surface of the material such as when it is folded or rolled up, it can weaken the structure of the strands and create depressions along the top surface. These depressions can cause loss of some of the loft and cushioning ability. To help alleviate this problem relief cuts can be made across the top surface of the material from edge to edge at 90 degrees from the direction of the material being rolled up, and approximately ¼" to ½" in depth and spaced every four (4) to six (6) inches apart as shown in E1 thru E10. These relief cuts allow the material when it is being rolled up to break away from the surface tension and not stretch and weaken the material. The cushion will be rolled up starting from J at the bottom to K at the top. The relief cuts are made from left edge to right edge at a 90 degree angle from the direction of the material being rolled up. The baffles 11A and 11B separate and hold in place the three (3) cushion cores of different densities shown at 10A, 10B, and 10C.

Figure 9:
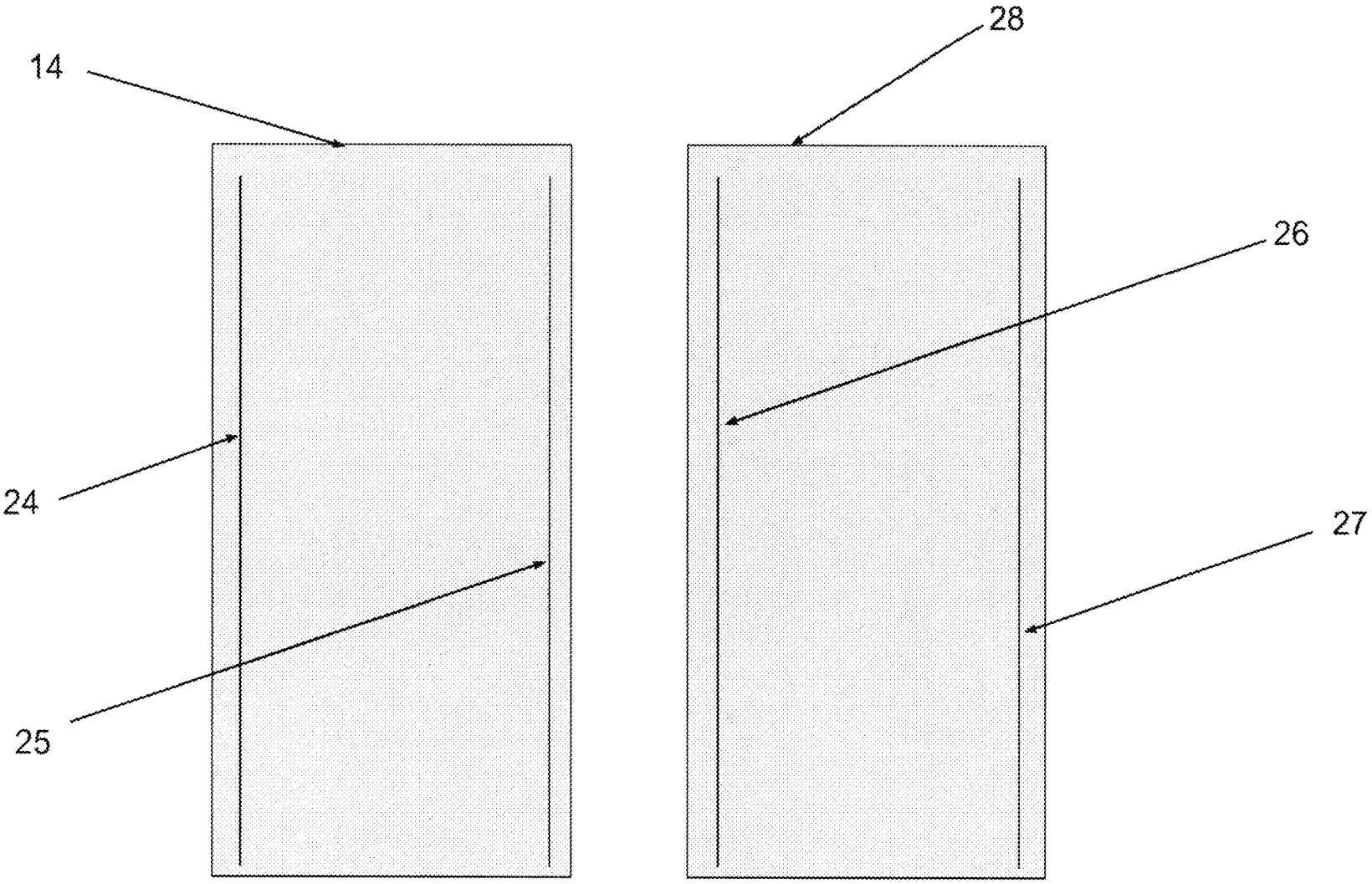
FIG. 9. is a top view showing zippers on the ends of the top side of the bed to removably attach an additional top sheet of fabric or quilted cover for added comfort.

As an additional embodiment of the Eco-Lastic mattress cover FIG. 9. Shows two (2) half zipper elements are sewn to the edges at 24 and 25 of the cover 14 and engage with two (2) half zipper elements 26 and 27 of cover 28. The cover of 28 can be made of many different fabrics as well as a quilted cover filled with polyester batting or other materials used in quilted covers. This allows the Eco-Lastic mattress to secure to its top panel of cover 14 a comfortable top sheet or quilted mattress cover 28 to rest on top of which can be made with many designs and thicknesses and sold as an add-on product.

Figure 10:
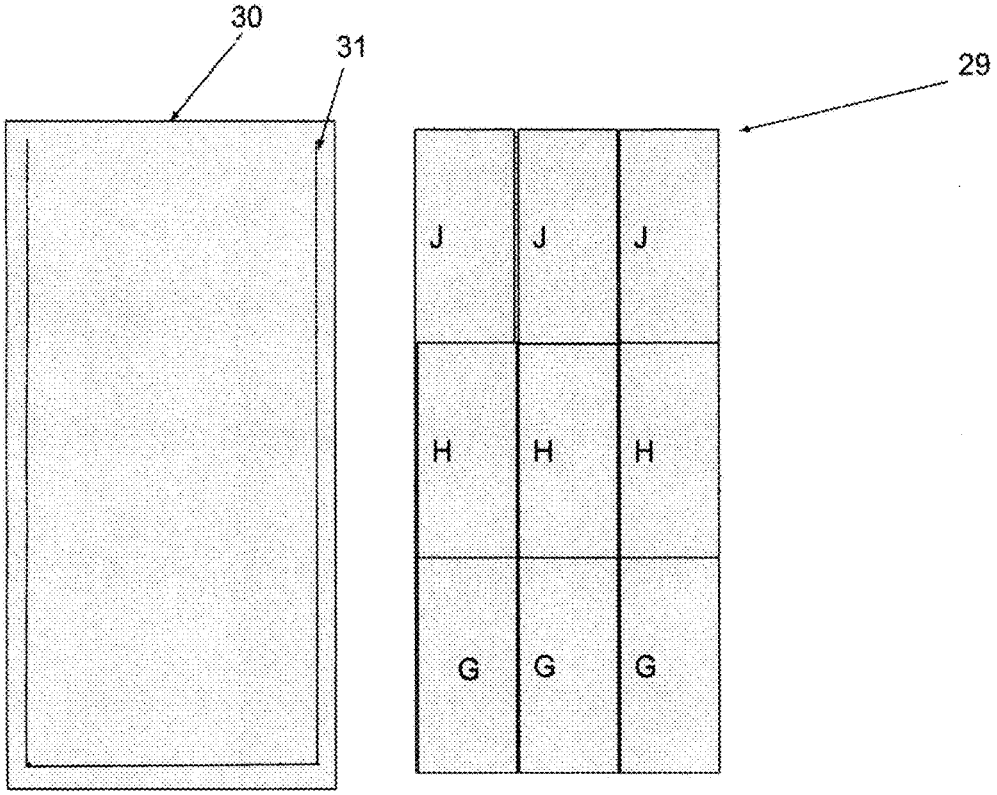
FIG. 10. is a bottom view showing a bed with a bottom zippered panel to open up so nine (9) cores can be inserted inside the cover.

FIG. 10. Illustrates another variation of the Eco-Lastic mattress which shows a standard queen mattress which measures 60" wide×80" long×6" thick, The cushions are made of nine (9) pieces as shown in 29 each measuring 20" wide×26⅜ long×6" thick and are laid side by side inside the bottom of a queen mattress cover shown at 30 made up of an attached top cover, side panel and bottom panel. The bottom panel of 30 has been removed for ease of viewing and has a hidden zipper 31 attached at three (3) sides of its perimeter and allows the bottom panel to open up so the nine (9) cushions 29 can be inserted inside the bottom of the cover 30 side by side and zipped up and the mattress may be placed on top of a foundation, platform bed or the ground for use. The cover may have a slightly shorter side panel than the height of the cushions so as to make for a snug fit when zipped up and not allow the nine (9) cushions inside of the cover to move or shift. An object of this design is to have the nine (9) cushions vacuum sealed down by approximately 50% in height so when placed in a box along with the folded cover it can be shipped with reduced shipping costs. Additionally it is more convenient for a consumer to receive a box with smaller dimensions than a larger box which may require two (2) or more persons to lift and maneuver it inside doors and up or down stairs inside a home or apartment. The size of the shipping box for a queen mattress as described in this disclosure when reduced in height by a vacuum sealed bag would measure approximately 21" wide×27" long×30" in height and weigh approximately 35 lbs. Other size mattresses such as twin, full and king beds will have different measurements when cut into squares to fit in their respective covers. The size and therefore the number of the squares of the cushion cores that can fit into their respective cover can be changed to accommodate reduced shipping costs. The height of the cushions can also vary to make thicker or thinner mattresses. The preferred cushioning material of the cores to be used is shown at 12 in FIG. 1. The density of the cores can vary to change the feel and support of the mattress. The nine (9) cores can be made of different densities distributed inside the cover 30 to keep weight, bulk and cost down of the Eco-Lastic mattress. The lower section G made of 3 cores across the bottom of the mattress can have the lowest and lightest density of cushions where the weight of the body is not as crucial, the three (3) cores running across the midsection H has the highest firmest density to support the hip section, and the top section J supporting the upper body, shoulders and head can be made up of three (3) cores running across the top of the mattress in medium density cushions. The design in this embodiment would reduce manufacturing costs and would be easier for the consumer to put the mattress together.

Figure 11:
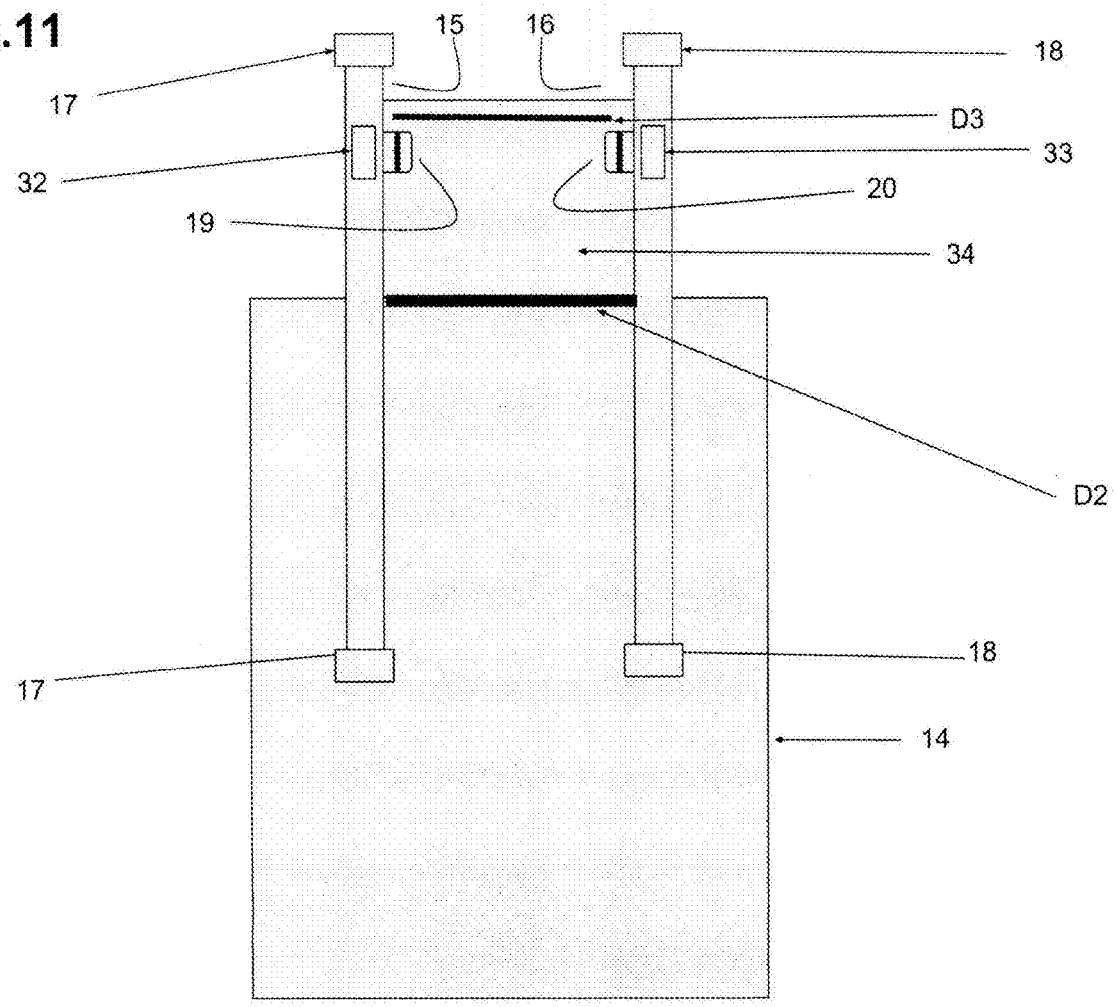
FIG. 11. is a bottom view of the camping bed showing a removably attached pocket at its top end with a zippered enclosure. Also showing are adjustable webbing straps that engage it's ends to secure the bed when rolled/folded up and create a self contained carry case without the need of an additional carry bag.

FIG. 11 shows a pocket 34 attached to the top of cover 14 removably attached by a separating zipper at D2. All of the webbing 15 and 16, plastic buckles to engage the ends of the webbing at 17 and 18 and D-rings 19 and 20 attached to the webbing to secure a shoulder strap for carrying the bed are all attached to the pocket. The webbing straps are sewn to the pocket at stitching 32 and 33. When the pocket is removed from the cover 14 by the separating zipper at D2 all of these components that are attached to the pocket are removed from the cover 14, this is so that if the cover 14 is to be washed by hand or mechanical means by way of a washer/dryer they will not interfere with the cleaning process eg: the long webbing straps becoming entangled in a washer/dryer. The zipper at D3 attached to the pocket 34 creates an enclosure for the pocket which can be used for storage or to place a small jacket or other clothing items to create a pillow effect. Additionally the pocket 34 can be sewn directly to cover 14 without the separating zipper D2. Additionally the cover 14 can use any combination of baffles and varying densities of cushions as illustrated in FIG. 3, FIG. 4, FIG. 5 and FIG. 12. The pocket of 34 can also be a layer of fabric that has no zipper enclosure.

Figure 12:
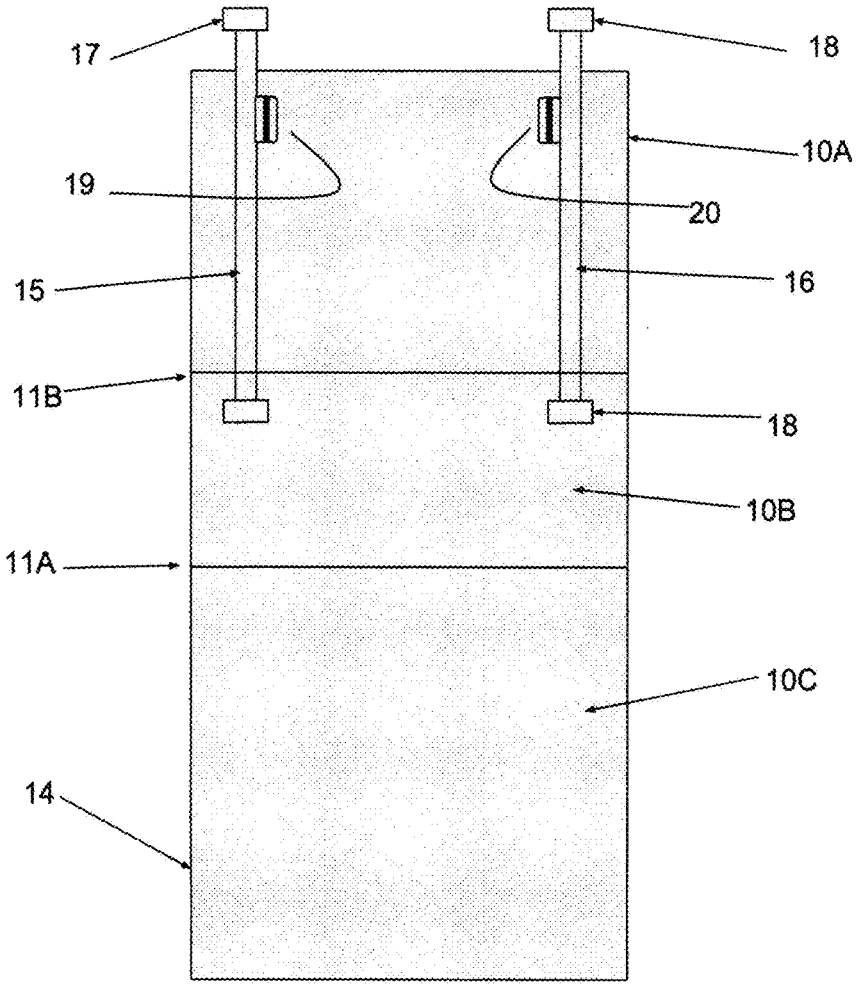
FIG. 12. is a bottom view of the camping bed showing attached webbing straps with ends that engage to secure the camping bed when rolled/folded up.

FIG. 12 shows two (2) webbing straps 15 and 16 sewn to the bottom panel of cover 14 with buckles 17 and 18 on opposite ends of the webbing straps which are engaged to hold the mattress secure when rolled or folded up. D-rings 19 and 20 attached to the webbing straps secure a shoulder strap for carrying the bed. The baffles 11A and 11B are sewn between the bottom and top layer of the cover 14 and separate and secure three (3) cushions 10A,10B, and 10C of varying densities. The baffles will have the same height or slightly shorter than the height of the cushions so to help keep the top layer of the cover taught and the cushions securely in place. The baffles do not have to run from edge to edge of the cover but have a space on each side so as to allow the cover to be opened up enough to insert the cushions.

Figure 13:
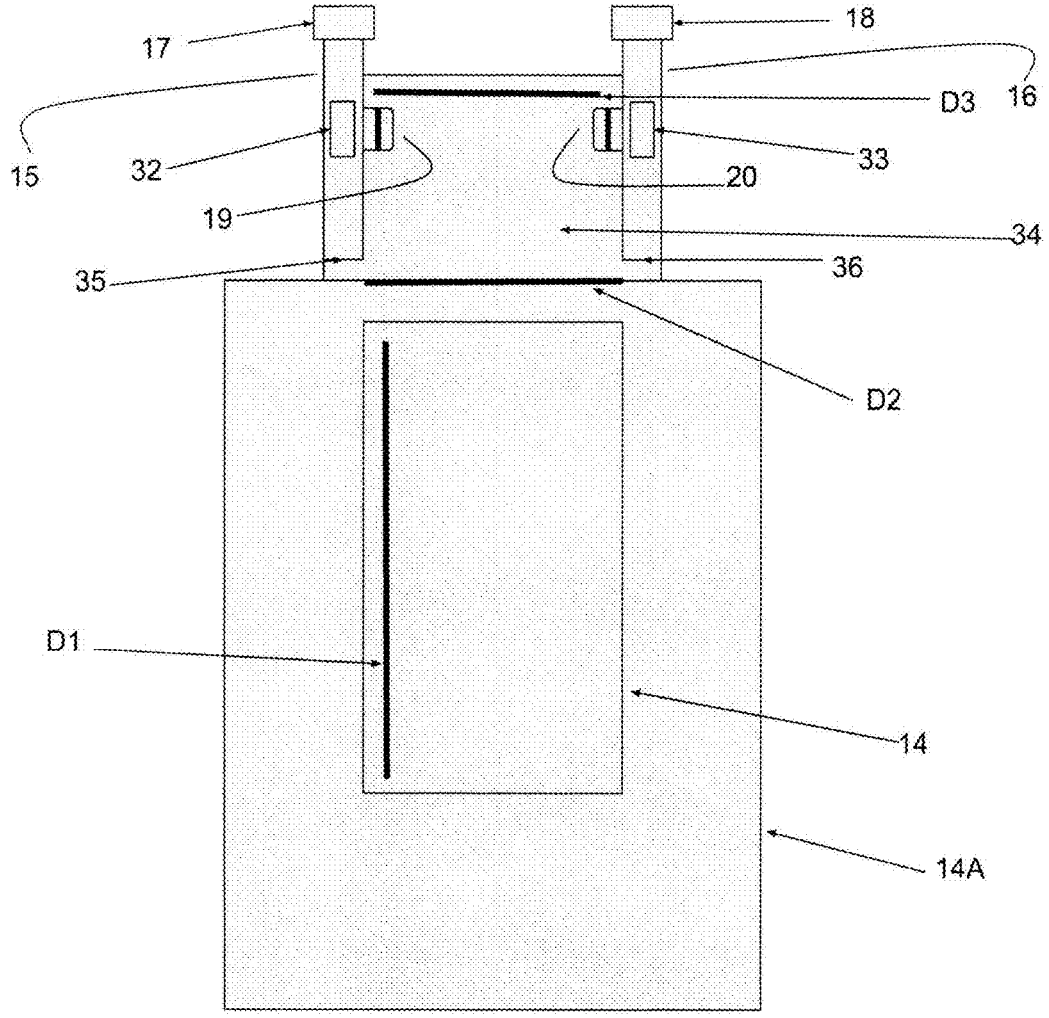
FIG. 13. is a bottom view of a recreational blanket with a zippered pocket to allow a cushion core to be inserted and a removably attached pocket with zippered enclosure at one (1) end.
Figure 14:
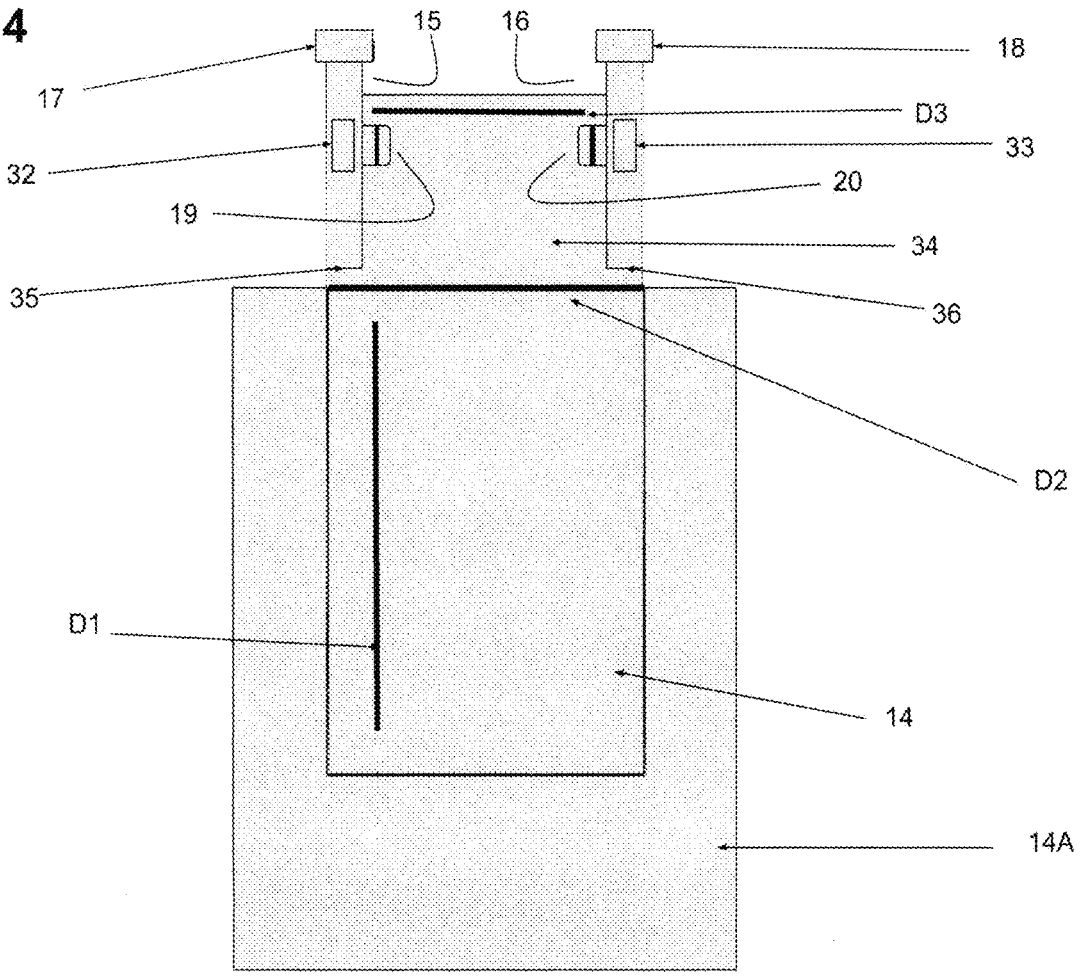
FIG. 14. is a bottom view of a recreational blanket with a zippered pocket to allow a cushion core to be inserted and a attached pocket with zippered enclosure at one (1) end. The blanket is removably attached to the pad at the top of the cushion pocket.

FIG. 13 shows a variation of the camping bed where the cover 14 with the cushion insert is sewn to a beach towel 14A. Pocket 34 is removably attached by a separating zipper at D2 to the top portion of a beach towel 14A. The zipper at D1 allows a cushion to be inserted into cover 14. The attached pocket 34 with zipper enclosure D3 has all of the webbing 15 and 16, buckles to engage the ends of the webbing at 17 and 18 and D-rings 19 and 20 attached to the webbing to secure a shoulder strap for carrying the padded beach towel bed and are all attached to pocket 34. When the pocket is removed from the beach towel 14A by the separating zipper at D2 all of these components attached to pocket 34 are removed with it. This is so the beach towel and cover can be laundered without the, webbing, buckles and other components attached. Additionally the cover 14 can use any combination of baffles and varying densities of cushions as illustrated in FIG. 3, FIG. 4, FIG. 5 and FIG. 12 and these cushions can be removed by zipper D1 when cleaning the beach towel and cover. The ends of the webbing straps 15 and 16 have been removed at 35 and 36 for illustrative purposes so as to not obstruct the diagram FIG. 14 shows a variation of the camping bed where the cover 14 with the cushion insert inside and attached pocket 34 is removably attached by a separating zipper at D2 at the top portion of a beach towel 14A. The zipper at D1 allows a cushion to be inserted into cover 14. The attached pocket 34 with zipper enclosure D3 has all of the webbing 15 and 16, buckles to engage the ends of the webbing at 17 and 18 and D-rings 19 and 20 attached to the webbing to secure a shoulder strap for carrying the bed when rolled up. When the pocket and attached cover 14 are removed from the beach towel 14A by the separating zipper at D2 all of these components attached to pocket 14 are removed from the beach towel 14A. This is so the beach towel can be laundered without the cushions, webbing, buckles and other components attached. Additionally the cover 14 can use any combination of baffles and varying densities of cushions as illustrated in FIG. 3, FIG. 4, FIG. 5 and FIG. 12 and can take on many different sizes. The cushions can be removed by zipper D1 when cleaning the beach towel and cover. The ends of the webbing straps 15 and 16 have been removed at 35 and 36 for illustrative purposes so as to not obstruct the diagram.

Figure 15:
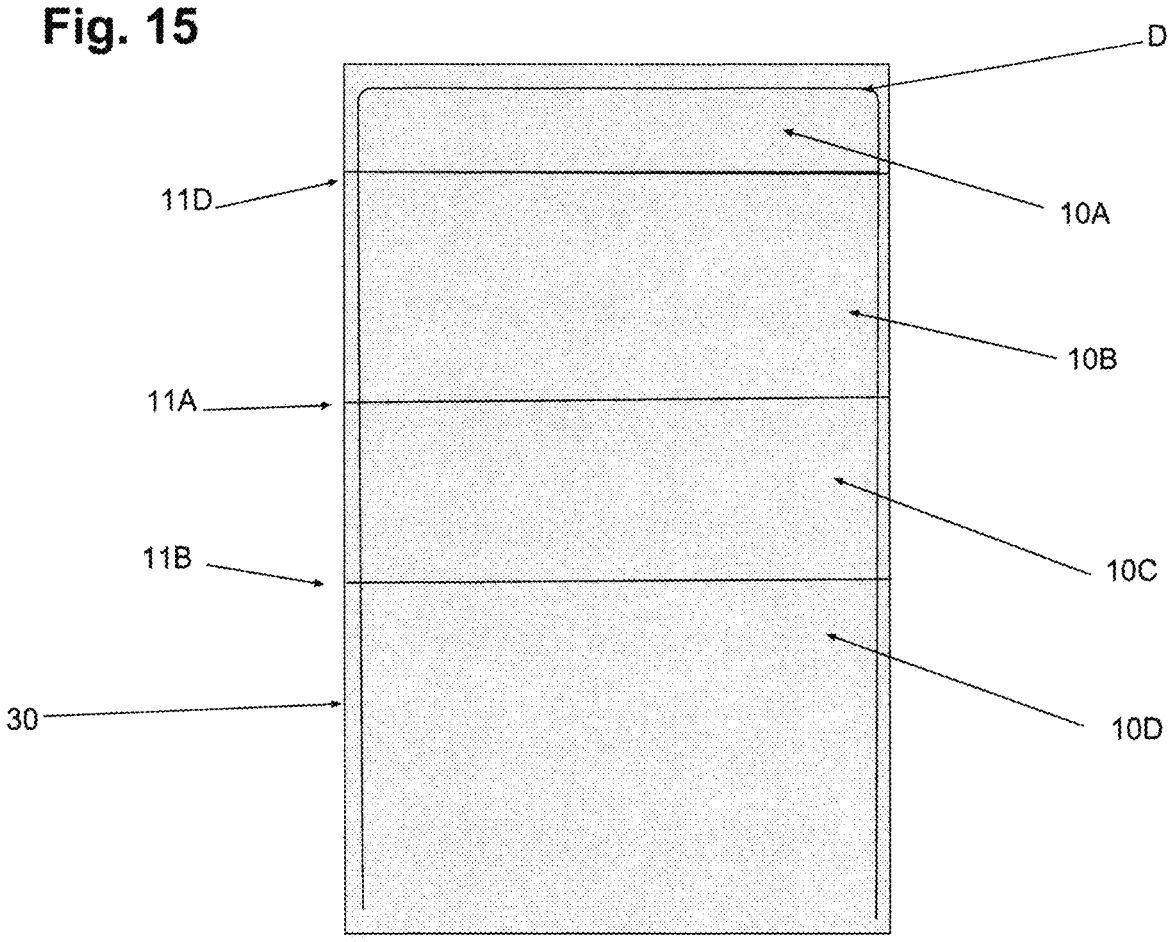
FIG. 15. is a bottom view showing a bed with a bottom zippered panel to open up so four (4) vertical cores of different densities can be inserted inside the cover.

FIG. 15 shows a variation of the Eco-Lastic mattress in a standard queen size bed as referenced in FIG. 10. The mattress measures 60" wide×80" long and can be made 3" or 4" thick. The cushions are made of four (4) sections 10A, 10B, 10C, and 10D and are laid side by side vertically inside the bottom of a queen mattress cover shown at 30. The mattress cover 30 is made up of an attached top cover, side panel and bottom panel. The bottom panel of 30 has been removed for ease of viewing and has a hidden zipper D attached at three (3) sides of its perimeter and allows the bottom panel to open up so the four (4) cushions can be inserted inside the bottom of the cover and zipped up. The mattress may be placed on top of a foundation, platform bed or the ground for use. The cover may have a slightly shorter side panel than the height of the cushions so as to make for a snug fit when zipped up and not allow the four (4) cushions inside of the cover to move or shift. Additionally the Eco-Lastic mattress can use any combination of baffles and varying densities of cushions as illustrated in FIG. 3, FIG. 4, FIG. 5 and FIG. 12.

Figure 16:
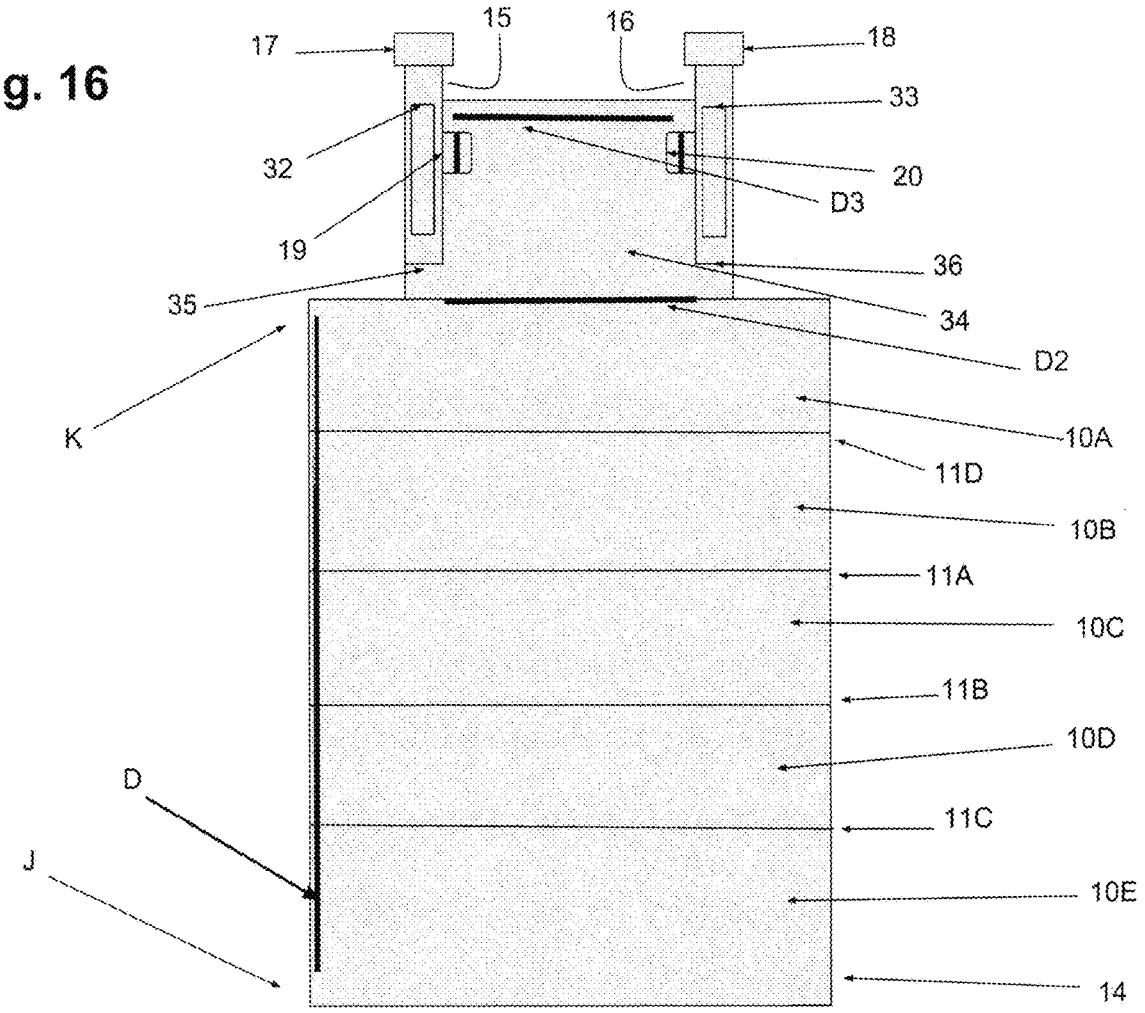
FIG. 16 is a bottom view of the camping bed showing a removably attached pocket at its top end with a zippered enclosure. The body of the bed uses 4 baffles to separate cushion cores. Also showing are adjustable webbing straps that engage it's ends to secure the bed when rolled up and create a self contained carry case without the need of an additional carry bag.
Figure 17:
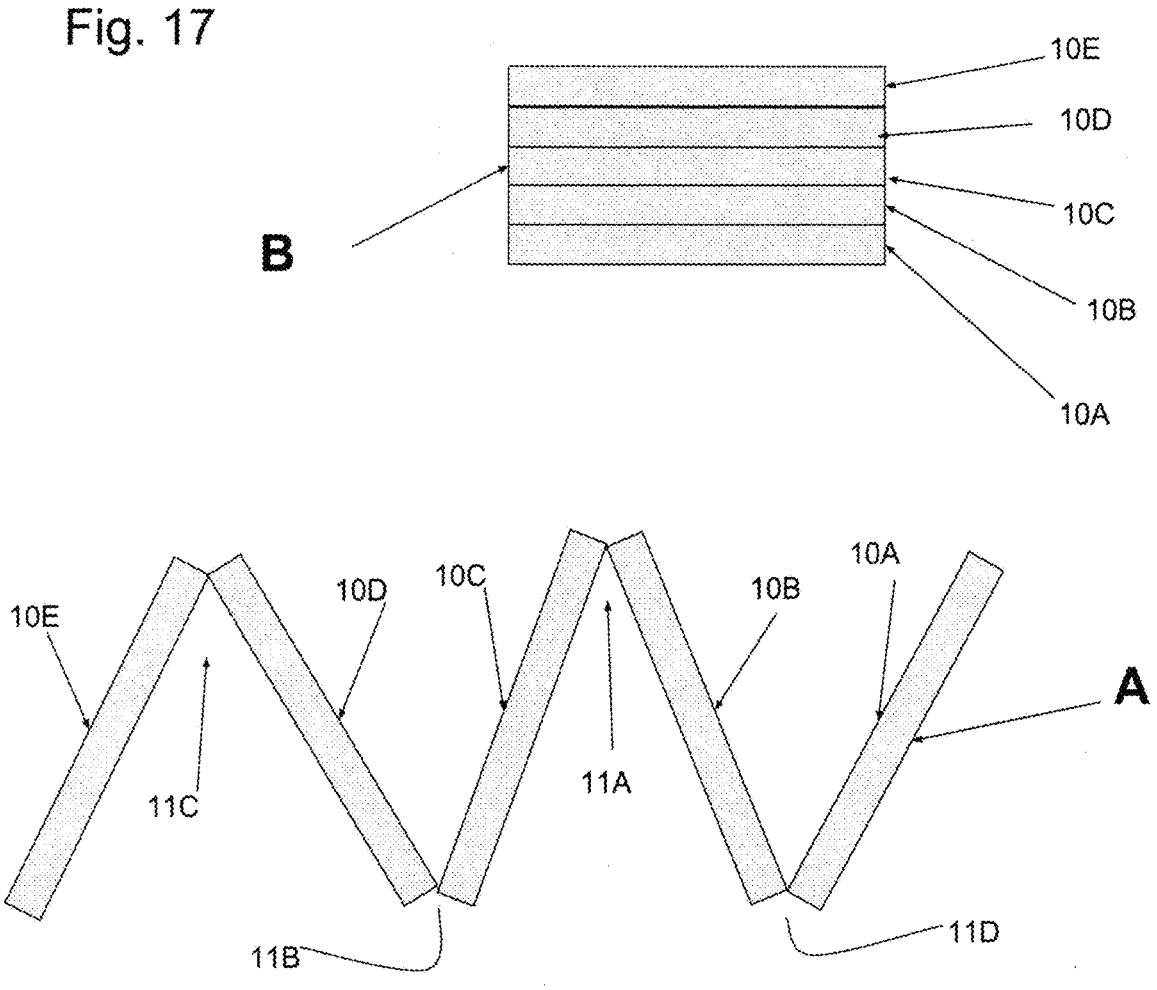
FIG. 17 illustrates how the camping bed gets folded up like an accordian and not rolled up. A side view also shows how the bed looks stacked up after it has been folded.

FIG. 16 shows a variation of the Eco-Lastic camping bed whereas five (5) inside cushions of varying densities are separated by four (4) baffles. In a standard size camping bed 72 inches in length the four (4) baffles will be spaced nearly equally apart from the bottom of the bed J to the top of the bed K. As an example the first baffle 11C is spaced 14.4 inches from the bottom of the bed J, the next baffle 11B is spaced 14.4 inches from 11C, the next baffle 11A is spaced 14.4 inches from baffle 11B, the next baffle 11D is spaced 14.4 inches from 11A. This configuration of baffles allows the bed to be folded evenly like an accordian instead of being rolled up, the baffles act like a hinge to allow a break between the cushions so they do not have to be bent and can lay flat and evenly on top of each other as shown in FIG. 17. The pocket 34 with zippered enclosure D3 is removably attached from cover 14 by a separating zipper at D2. When the pocket 34 is removed from cover 14 all of the webbing straps, buckles and D-rings are removed with it. For illustrative purposes the ends of the webbing straps 15 and 16 have been removed at 35 and 36 to show the internal bed construction. The webbing straps 15 and 16 are sewn to the pocket 34 at 32 and 33 and can be sewn all the way down on each side of the pocket or sewn partially down on each side of the pocket. The buckles, zippers and D-rings use the same layout as in FIG. 11. The webbing straps 15 and 16 would wrap around the bed when folded up and secure the bed to keep it from opening up by engaging buckles 17 and 18 at the ends of the webbing straps 15 and 16.

FIG. 17 shows the folded accordion design as opposed to the Eco-Lastic bed being rolled up. FIG. 17 A shows a side view of how the bed would fold up. The cushions 10A, 10B, 10C, 10D, and 10E are folded at the baffles 11D,11A,11B and 11C. The cover 14 is left out of this diagram for illustrative purposes. The cover has a top layer and a bottom layer and the baffles are sewn between the two (2) layers of fabric, the cover can also have a top layer and a bottom layer joined together, by a side panel. If the cover has a top and bottom layer sewn or attached to a side panel the side panel can attach around all four (4) sides of each cushion and be connected at the bottom of the cover 10E and 10D at the top of the cover 10C and 10B and connected at the bottom of 10B and 10A so that the cover can fold like and accordian. The side view in FIG. 17. B shows the cushions 10A,10B, 10C,10D, and 10E completely folded up and laying flat. The individual cushions do not stick out or hang over the sides but have flush vertical and horizontal sides, this is so the beds can be easily secured by the webbing straps without bending cushions that are sticking out of the sides, additionally the beds can be stacked evenly on top of each other and on its sides to keep shipping and container costs down.

Figure 18:
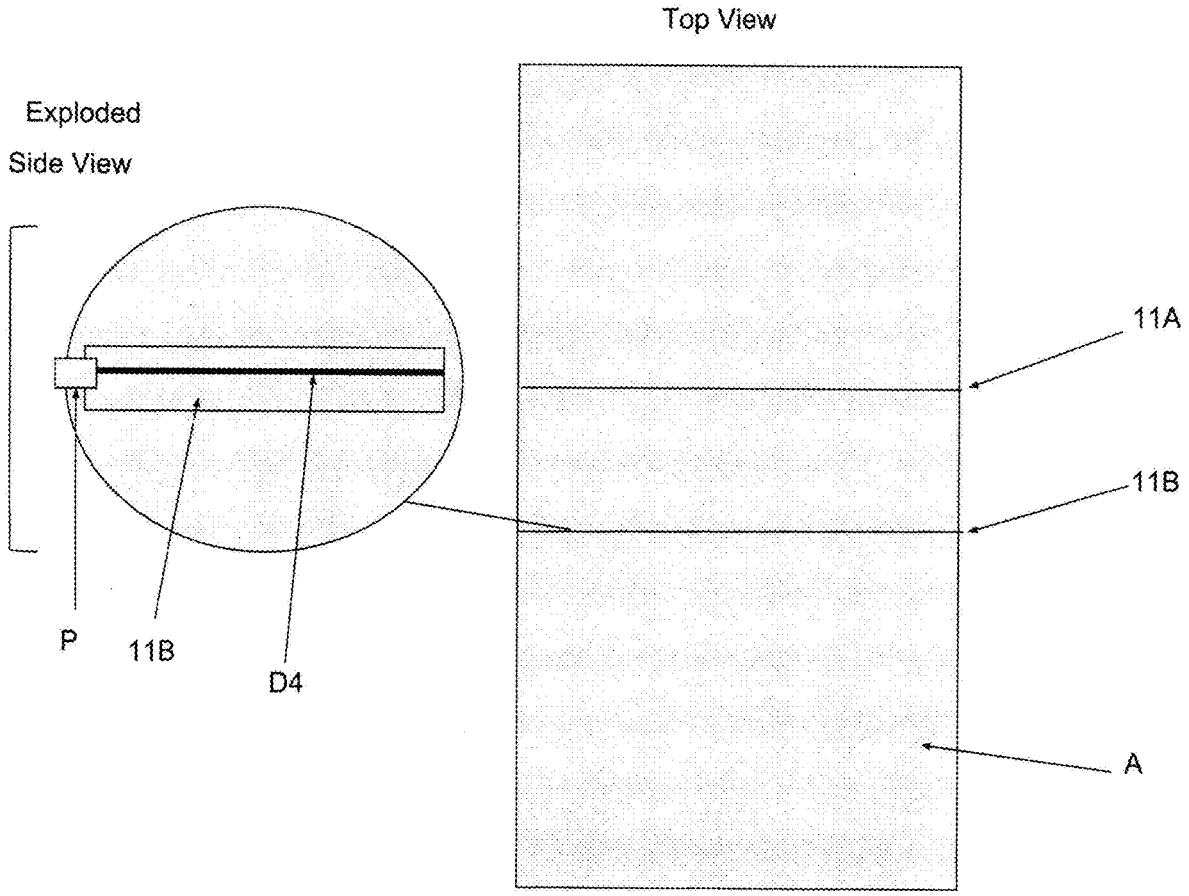
FIG. 18 shows a top view of the recreational bed and an exploded view of a baffle inside with a zipper running down the center of the baffle with a pull tab to grasp the zipper end.

FIG. 18 shows a top view of the recreational bed (A) and an exploded view of a baffle 11B with a zipper D4 running down the center of the baffle with a pull tab (P) to grasp the zipper end. The zipper when unzipped allows the cover to expand and open up, this allows for easier access to insert and remove the cushions from inside the cover. One of the higher density cushions that make up the hip section of the bed can also have it's own cover wrapped around it so once it is removed from the cover it can be used a seat cushion by itself.

Figure 19:
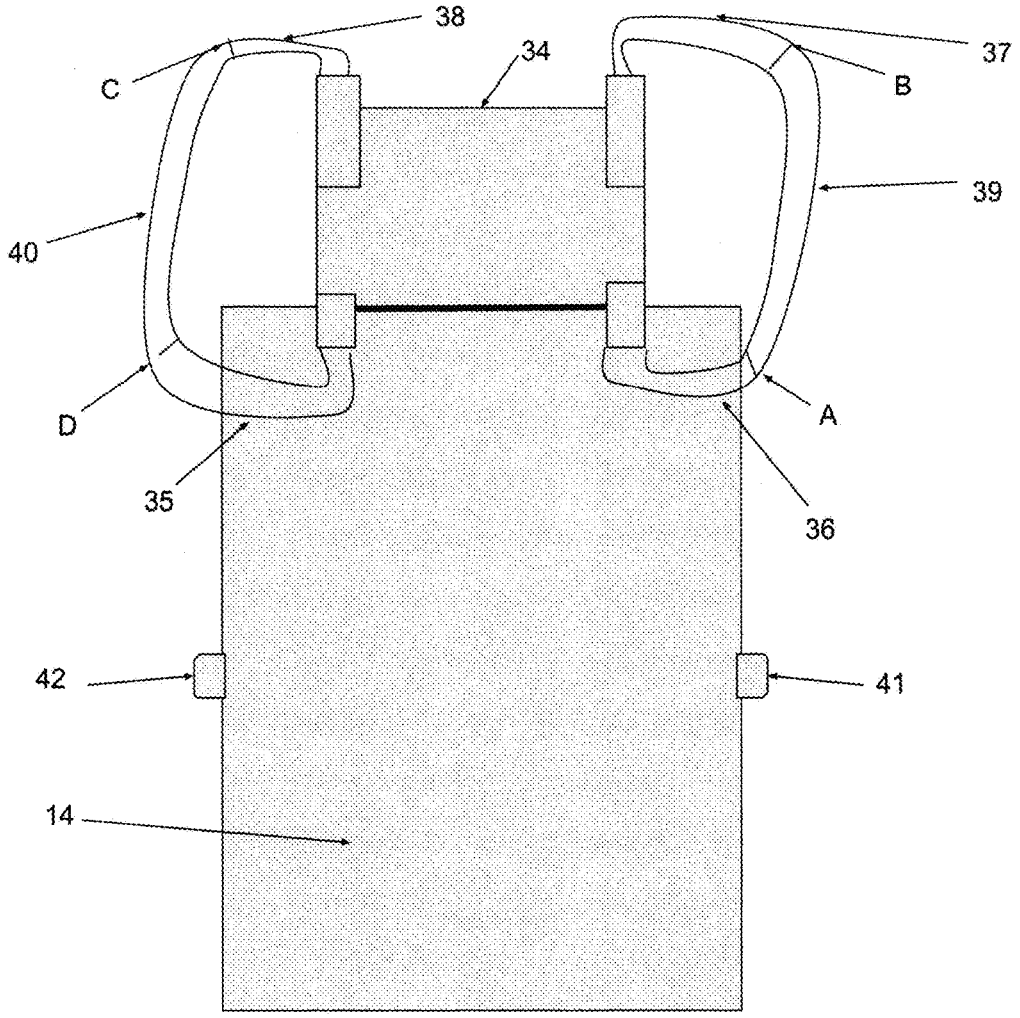
FIG. 19 shows a new configuration for the webbing straps that secure the bed for transport after it has been folded up.

FIG. 19 shows a different configuration for the webbing straps to hold together the Eco-Lastic bed after it has been folded up. The webbing at 37 and 38 is sewn into the top end of the pocket 34 and the other ends of the webbing 35 and 36 sewn into the cover 14 and bottom end of the pocket 34 at the seam. Elastic bands 39 and 40 are attached/sewn to the webbing ends 35,36,37,38 at A, B, C, D. This forms two (2) loops of webbing each with partial strips of elastic so once the bed is folded up the two (2) loops can wrap around the bed and the elastic can stretch and secure the folded bed together for storage or transport. The D-rings 41 and 42 are attached at the center of the bed at its sides so a shoulder strap can engage the rings to be used to carry the bed.

Figure 20:
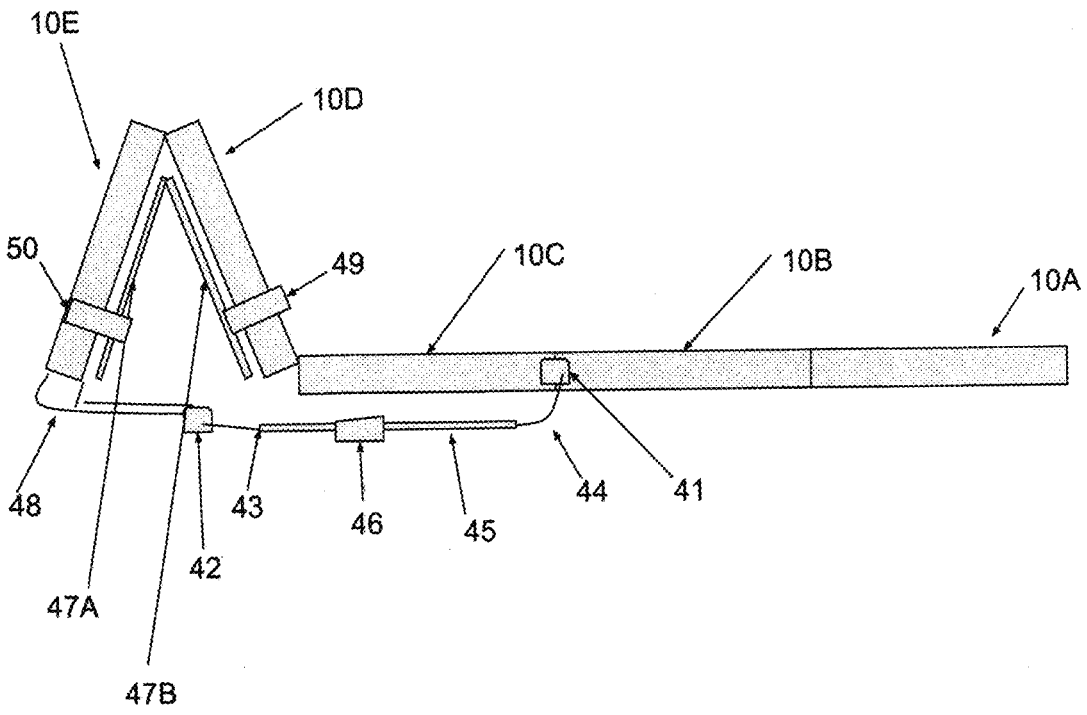

FIG. 20 shows an A-frame made of two (2) rigid panels 47A and 47B that are hinged at the top of the A-frame, the panels can be made of many different lightweight materials eg: plastic.fiberglass, composites or a combination thereof with sufficient strength to support the weight of a person, the A-frame panels act as a sturdy adjustable structure to be a back support for the Eco-Lastic bed so a person can sit upright or adjust the panels to lay in a semi upright position. The Two (2) panels can be enclosed in a cover. One side of the A-Frame rests on the top of the pocket 48 and can have two (2) straps 49 and 50 to wrap around the cover at 10E and 10D to secure itself to the bed, additionally the cover can have one (1) strap at 47B to be secured around the cover at cushion 10E and the A-frame side 47A will not rest against the cover but stand alone at the back of the cover. The straps can have removable fasteners that adjust to tighten or loosen around the cover. D-rings 42 and 41 will engage a length of adjustable webbing to adjust the angle of the A-Frame so one can sit upright or lay back in a semi upright position. The D-rings 42 can be attached to each side of the pocket 48, or the webbing 35 and 36 in FIG. 19, or to the lower end of the cover that surrounds the A-frame that rests on the pocket 48.or attached to the A-frame itself. Hooks 43 and 44 engage D-rings 42 and 41. Each end of the hooks are attached to webbing 45 with an attached ladder lock 46 or other adjustable clip to shorten or lengthen the webbing. The webbing strap 45 can be shortened by the ladder lock or other adjustable clip 46 and the A-frame panels pulled closer together for an upright sitting position or the webbing lengthened and the A-Frame opened wider to create a semi upright position to lay on. This webbing configuration will be on both sides of the bed and not shown in the diagram for easier illustration. While sitting on the bed the adjustable straps will be on each side of the cover so one can adjust the straps from a sitting position to sit upright or adjust to different positions of semi upright. 10A,10B,10C,10D, and 10E are the cushions, the cover that surround the cushions is left out in this illustration. The A-frame panels can also be inserted inside the cover below cushions 10E and 10D. If the A-frame is inserted into the cover the baffle that separates cushions 10E and 10D can be removed at the hinge locations of the A-frame and the remaining sections of baffle held together by a hook and loop fastener so that the baffles can be removably fastened to allow the A-frame panels to be inserted into the cover without the obstruction of the baffle. The baffle has one side attached to the top panel of the cover and the other side attached to the bottom panel with the hook and loop fasteners facing each other to be engaged.

Figure 21:
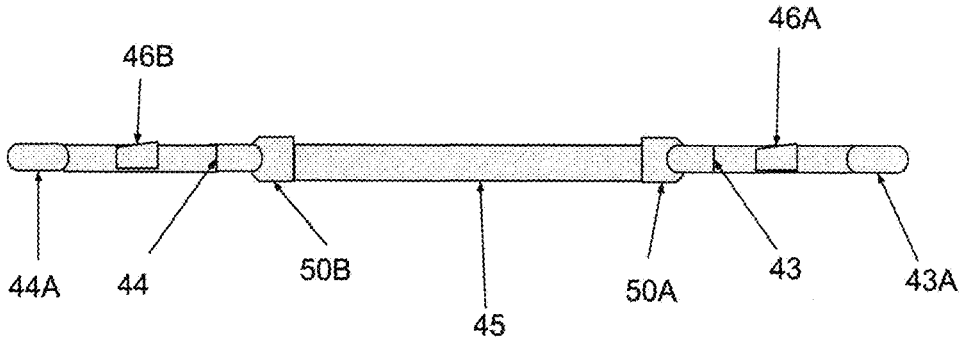
FIG. 21 shows a shoulder strap that can be used to carry the bed once it has been folded up and additionally separated to form two (2) adjustable webbing straps that is used to adjust the angle of the A-Frame and the bed that rests on top for sitting upright or many different semi upright positions.

FIG. 21 shows a shoulder strap that can be separated by hooks at 44 and 43 from D-rings 50 A and 50 B to be used as the webbing straps 45 in FIG. 20. Each of these separated webbing straps can be used to adjust the angle of the A-Frame 47A and 47B in FIG. 20. by attaching the hooks of the straps 43 and 43A to the D-rings on the sides of the cover 41 the other side of the cover (not shown in this diagram (and to the D-rings on each bottom side of the A-frame FIG. 20 47A, or to each side of the pocket attached to the cover FIG. 20 48 or to the two (2) webbing straps attached to the cover FIG. 19 37 and 38 which is used to secure the bed after it has been folded up. The ladder locks or other adjustable style clips at 46A and 46B allow each separated strap in FIG. 21 to adjust in length so as to change the angle of the A-Frame 47A and 47B in FIG. 20. The separated straps can be joined together at 50A and 50B to create a single shoulder strap that is used to carry the Eco-Lastic bed once it has been folded up for easy transport.

I claim:

1. A cushion comprising:

at least four cores of cushioning material having varying densities and thicknesses, wherein each core has a rectangular shape and is located adjacent another core along a side;

a cover made of a top panel and a bottom panel enclosing the cores, wherein the cover can be folded like an accordion long the sides of each core to form a rectangular stack of cores;

a zipper on the cover to allow the cores to be inserted or removed;

a pocket attached to an end of the cover having approximately the same width as the cover, the pocket having a zipper along one side;

a webbing strap attached to one end of the pocket; and an elastic strap attached to an opposite end of the pocket, wherein the webbing strap is attached to the elastic strap to form a loop;

wherein the loop can be stretched around the cover when the cover is folded into the rectangular stack of cores to secure the cover for storage and transportation.

2. The cushion of claim 1, further comprising a second loop of webbing and elastic straps attached at separate ends of the pocket.

3. The cushion of claim 2, wherein the two loops have buckles at their ends to adjust the length of each loop.

4. The cushion of claim 3, wherein the two loops are connected to each other via another buckle.

5. The cushion of claim 1, further comprising a handle attached to the bottom panel of the cover and positioned to be accessed when the cover is folded into the rectangular stack of cores.

6. The cushion of claim 1, further comprising a pad placed on top of at least one of the cores within the cover.

* * * * *